US006226910B1

(12) United States Patent
Ireland

(10) Patent No.: US 6,226,910 B1
(45) Date of Patent: May 8, 2001

(54) MERCHANDISING SHELF BRACKET

(75) Inventor: David S. Ireland, Akron, OH (US)

(73) Assignee: Darko Company, Inc., Twinsburg, OH (US)

( * ) Notice: Subject to any disclaimer, the term of this patent is extended or adjusted under 35 U.S.C. 154(b) by 0 days.

(21) Appl. No.: 09/327,267

(22) Filed: Jun. 7, 1999

(51) Int. Cl.[7] ..... G09F 3/20
(52) U.S. Cl. ..... 40/661.03; 40/651
(58) Field of Search ..... 40/642.02, 651, 40/658, 661, 661.03, 101

(56) References Cited

U.S. PATENT DOCUMENTS

| | | | | |
|---|---|---|---|---|
| 4,745,695 | * | 5/1988 | Hetzer | 40/661 |
| 4,866,868 | * | 9/1989 | Kass | 40/661 |
| 5,044,104 | * | 9/1991 | Hopperdietzel | 40/661 X |
| 5,488,793 | * | 2/1996 | Gebka et al. | 40/661.03 |
| 5,899,011 | * | 5/1999 | Brinkman | 40/661.03 |

FOREIGN PATENT DOCUMENTS

| | | | | |
|---|---|---|---|---|
| 9105324 | * | 4/1991 | (WO) | 40/101 |
| 9220056 | * | 11/1992 | (WO) | 40/101 |

OTHER PUBLICATIONS

Fasteners For Retail, Inc. "Your Supporting Cast of Display Accessories" brochure excerpt, p. 64 (1996).

* cited by examiner

*Primary Examiner*—Brian K. Green
(74) *Attorney, Agent, or Firm*—Renner, Kenner, Greive, Bobak, Taylor & Weber

(57) ABSTRACT

A bracket (10) includes a back wall (18) having hooks (19, 20) to engage hooks (14, 15) on the edge (13) of a shelf (11). A ledge (16) is formed at one end of the wall (18) and a hinge (26) is formed at the other end of the wall (18). The hinge (26) connects the wall (18) to a cover (25) such that when the cover (25) is pivoted relative to the wall (18), the ledge (16) and any indicia (34) positioned on the ledge (16) is exposed. A transparent panel (30) is connected to the cover (25) and is spaced from the cover (25) to form a channel (31) therebetween. An insert (32) carrying indicia (33) may be received in the channel (31), and the indicia (33) is thereby visible through the panel (30).

15 Claims, 3 Drawing Sheets

MERCHANDISING SHELF BRACKET

TECHNICAL FIELD

This invention relates to a bracket for mounting on the edge of a merchandising shelf. More particularly, this invention relates to such a bracket which can fit on most conventional merchandising shelves and which presents an aesthetic finish to the shelves. More specifically, this invention provides a mechanism by which merchandising indicia may be displayed to the public with other indicia being privately available to the retailer.

BACKGROUND ART

Most conventional merchandising shelving fixtures utilized to display the wares of the retailer are formed with shelves having pocket-like recesses in the front peripheral edge of the shelves. The pocket-like recesses in the front edge of the shelves provide the functional advantage of being able to snap fit small signs or the like at the edge of the shelf to identify, price, or otherwise advertise the merchandise being carried on the shelf. However, the bare shelf edge, or shelf edge carrying small signs, presents a very unfinished look to the shelves. While many retailers may believe that such is unappealing to their customers, few retailers wish to spend the additional money required to provide a shelving fixture with a more finished and aesthetically appealing look. In addition, if the fixture is provided with such a more finished look, the ease of attaching signage to the shelves is eliminated.

Moreover, it is often desirable for the retailer to be able to access certain information regarding the merchandise being displayed, such as stored inventory information and the like, at the shelf location of the merchandise. However, such information may not be for public consumption, and presently known shelving systems do not provide the ability to access private information regarding the merchandise located at the display shelf.

Thus, the need exists for a merchandising shelf system which not only provides an aesthetically pleasing finished look, but which also provides a means by which public information may be displayed while at the same time providing a means by which access may be obtained to private information.

DISCLOSURE OF THE INVENTION

It is therefore an object of the present invention to provide a bracket which is attachable to the edge of most conventional merchandising shelves.

It is another object of the present invention to provide a bracket, as above, which is capable of selectively receiving and displaying signage and the like for public consumption.

It is an additional object of the present invention to provide a bracket, as above, which can carry other information which is out of the view of the public but which is readily available to the merchandiser.

It is a further object of the present invention to provide a bracket, as above, which provides the edge of a merchandising shelf with a finished look.

These and other objects of the present invention, as well as the advantages thereof over existing prior art forms, which will become apparent from the description to follow, are accomplished by the improvements hereinafter described and claimed.

In general, a bracket made in accordance with one aspect of the present invention includes a wall which carries hook members which are adapted to engage the edge of a shelf. A first member is carried by the wall and a second member is carried by the first member. The first and second members are spaced from each other to form a channel therebetween. The second member is transparent so that anything positioned in the channel is visible.

In accordance with another aspect of the present invention, a ledge is formed at one end of the wall and a hinge at the other end of the wall connects the wall to the first member. The first member may thus be pivoted with respect to the wall to expose the ledge.

A preferred exemplary bracket for a merchandising shelf incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
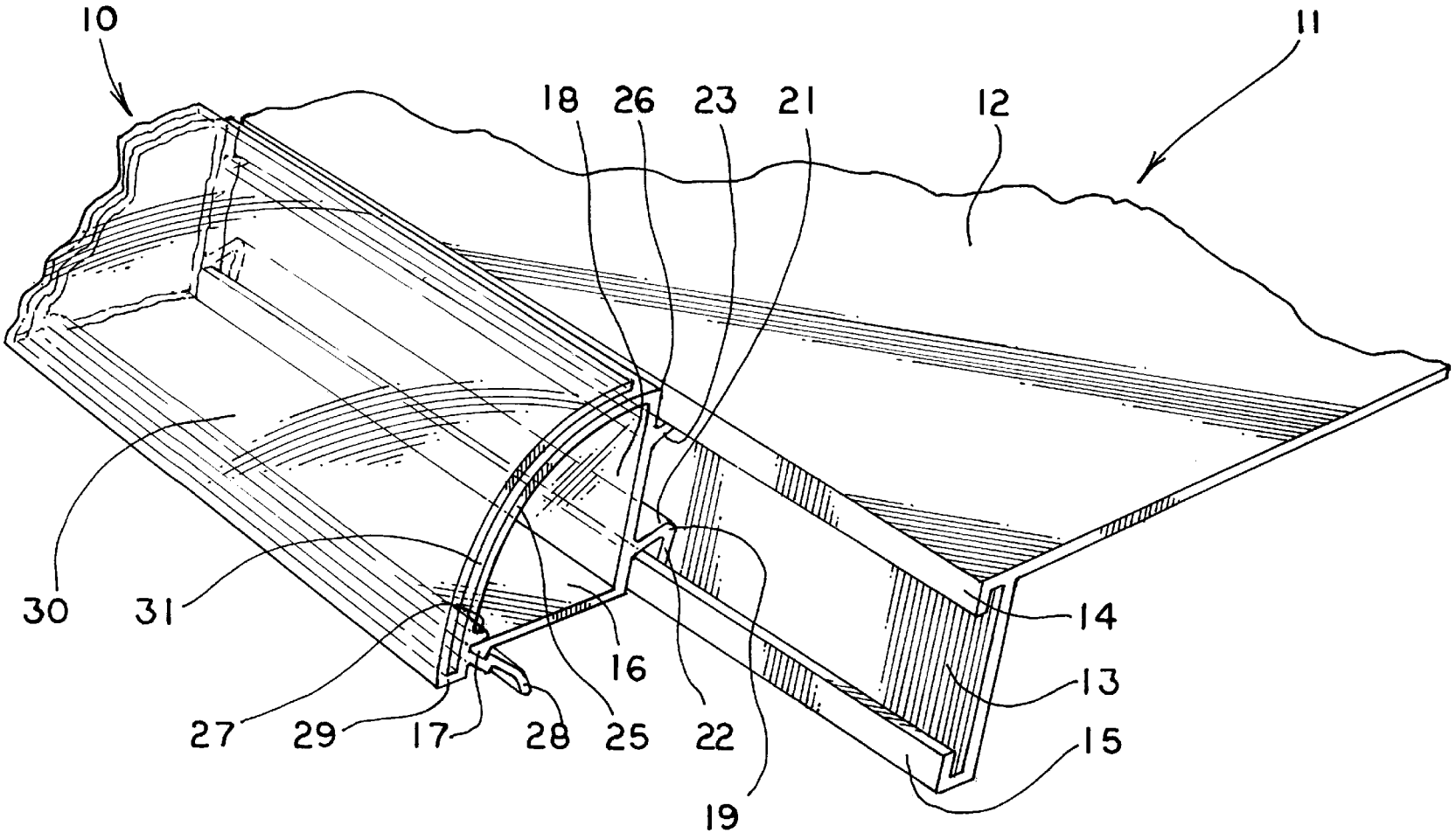
FIG. 1 is a fragmented, perspective view of a bracket, made in accordance with the present invention, shown as being positioned on the edge of a merchandising shelf.
Figure 2:
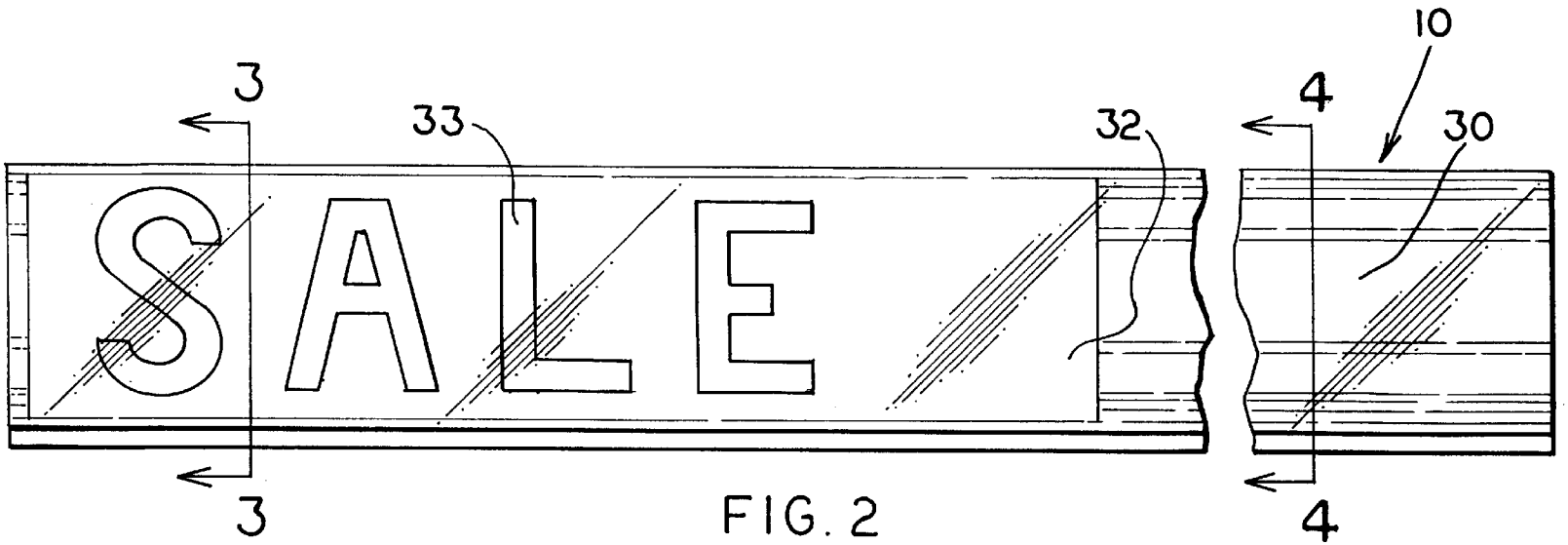
FIG. 2 is a front elevational view thereof, showing the manner in which information may be displayed to the public.

A bracket made in accordance with the concepts of the present invention is indicated generally by the numeral 10. Bracket 10 may be conveniently formed by co-existing a duodurometer polyvinyl chloride or equivalent plastic material, and cutting it to a desired length to fit along the length of a conventional merchandising shelf, generally indicated by the numeral 11. Shelf 11 includes a flat top surface 12 to receive merchandise thereon, and an outer channel edge 13 extending downwardly from top surface 12. Channel 13 is formed by an upper hook 14 located near the top of outer edge 13 and an opposed lower hook 15 located near the bottom of outer edge 13.

Bracket 10 is an elongate member which, as previously described, can be cut to length so as to preferably extend along the entire length of shelf outer edge 13. Bracket 10 includes a lower ledge 16 which, when bracket 10 is attached to shelf 11, extends generally horizontally outwardly from channel edge 13. A lock barb 17 may be formed near the outer edge of ledge 16.

A rear bracket wall 18 extends upwardly from the other edge of ledge 16 at an angle preferably slightly greater than ninety degrees. A lower, downwardly opening hook 19 and an upper, upwardly opening hook 20 extend outwardly from the back surface of rear wall 18. Hook 19 is configured to engage lower hook 15 of shelf channel 13, and hook 20 is configured to engage upper hook 14 of shelf channel 13. Although most conventional shelves 11 have similar hook configurations, hooks 19 and 20 are not only flexible to adapt to different shelves, but also are specially configured to assure that bracket 10 will universally fit onto most shelves. As such, hook 19 is formed with opposed projections 21 and 22, and hook 20 is formed with opposed projections 23 and 24. As bracket 10 is pressed against shelf channel 13, hooks 19 and 20 will flex sufficiently to allow projections 22 and 24 to flex and become fully engaged by hooks 15 and 14, respectively. As such, projections 22 and 24 spring back to contact channel edge 13 thereby locking bracket 10 in place. It is preferred that projection 22 of lower hook 19 be somewhat longer than projection 24 of upper hook 20 to allow for more flexibility of lower hook 19. Thus, upper hook 20 is usually installed first followed by the more flexible lower hook 19.

Figure 4:
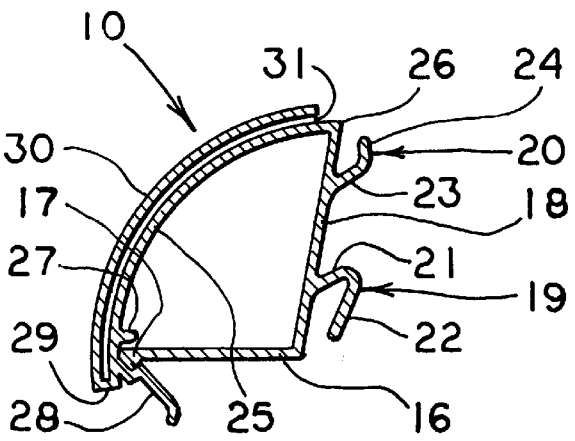
FIG. 4 is a sectional view taken substantially along line 4—4 of FIG. 2.
Figure 3:
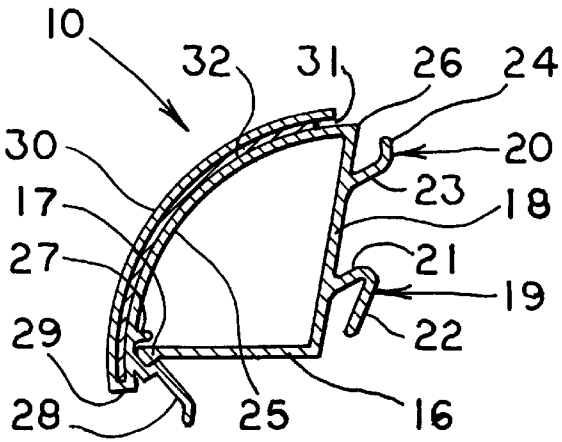
FIG. 3 is a sectional view taken substantially along line 3—3 of FIG. 2
Figure 6:
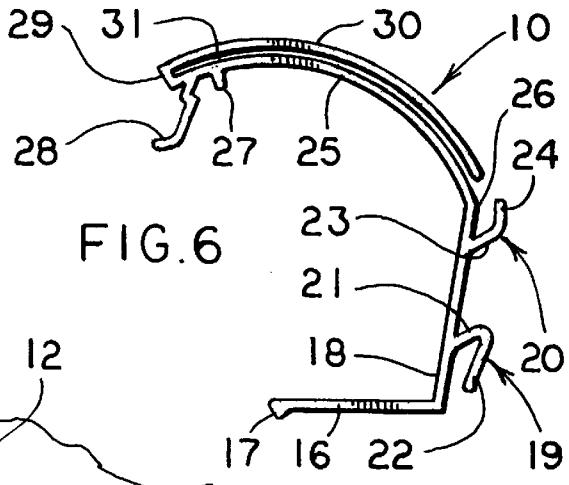
FIG. 6 is an end view of the bracket when in the position shown in FIG. 5.

Bracket 10 also includes an arcuate cover portion 25 which has one end attached to the top of rear wall 18 by a living hinge 26. As such, cover portion 25 can be pivoted on hinge 26 with respect to rear wall 18 from a position shown in FIGS. 1–4, to a position shown in FIGS. 5–6. A rib 27 extends inwardly from near the outer end of cover portion 25, and a pull tab 28 is formed at the outer end of cover position 25 and is spaced from rib 27. Lock barb 17 of ledge 16 is received between rib 27 and tab 28 to hold cover portion 25 in the position shown in FIGS. 1–4. Barb 17 may be released by simply pulling tab 28 outwardly, away from shelf 11, and then cover portion 25 may be rotated on hinge 26 to the position shown in FIGS. 4 and 5.

A ledge 29 extends outwardly from the bottom end of cover portion 25, and an arcuate panel 30 extends upwardly from the outer edge of ledge 29. Panel 30 thus parallels and is spaced from cover portion 25 to form a channel 31 therebetween with ledge 29 closing off one end of channel 31, the other three edges being open. Panel 30 is preferably formed of a clear or transparent material and channel 31 is adapted to receive an insert 32 through any of its open edges. Insert 32 is therefore visible to the public through panel 30. Insert 32 may be made of paper, card stock, or the like, and may, for example, merely be colored to match the color of shelf surface 12 to present an aesthetically pleasing finish to shelf 11. More importantly, insert 32 may be provided with indicia 33 thereon to convey one or more messages, such as pricing or other information about the merchandise being displayed to the public. Moreover, multiple separate inserts 32 may be inserted into channel 31 to convey different messages, or a single insert 32 may convey one or more messages.

Figure 5:
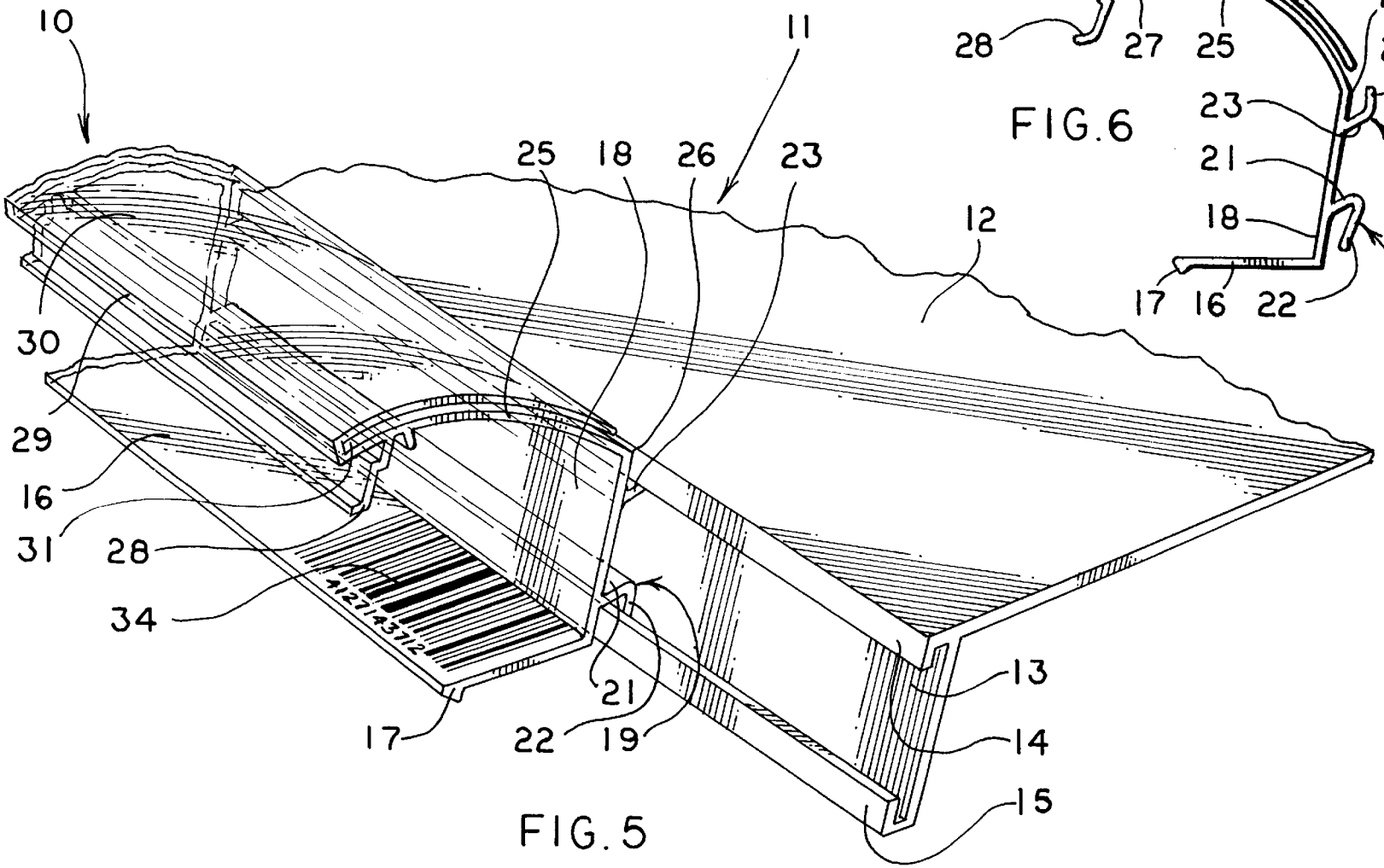
FIG. 5 is a fragmented, perspective view similar to FIG. 1 but showing a portion of the bracket pivoted with respect to other portions of the bracket to display information which may not be necessary for public consumption.

When closed, cover portion 25 hides indicia 34 which may be placed on lower ledge 16. Such indicia 34 could include the bar code as shown, stored inventory information, or other data regarding the merchandise being displayed which would not be necessary or desirable for public consumption. But the retailer would have access to that information by merely pulling on tab 28 and pivoting cover portion 25 relative to wall 18 on hinge 26 as shown in FIG. 5.

In light of the foregoing, it should thus be evident that a bracket constructed as described herein substantially improves the art and otherwise accomplishes the objects of the present invention.

What is claimed is:

1. A bracket adapted to be attached to an edge of a shelf, the bracket comprising a wall, a ledge carried by said wall, hook members carried by said wall and adapted to engage an edge of a shelf, a first member carried by said wall, a second member carried by said first member, said second member being spaced from said first member to form a channel therebetween, said second member being transparent so that anything positioned in said channel is visible through said second member, a hinge connecting said first member and said wall, said first and second members thereby being pivotable relative to said wall on said hinge thereby exposing said ledge, a lock barb on said ledge, and a tab on said first member, said tab engaging said barb to attach said first member to said ledge, said tab being adapted to be engaged and flexed to release said first member from said ledge.

2. A bracket according to claim 1 further comprising a rib carried by said first member, said barb being positionable between said rib and said tab.

3. A bracket according to claim 1 further comprising a second ledge connecting said first member to said second member and closing one side of said channel, the other sides of said channel being open.

4. A bracket according to claim 1 wherein said hook members include a first hook positioned near the top of said wall and a second hook near the bottom of said wall.

5. A bracket according to claim 1 wherein said first and second members are arcuate, thereby providing a finished look to a shelf.

6. A bracket adapted to be attached to an edge of a shelf, the bracket comprising a wall, hook members carried by said wall and adapted to engage an edge of a shelf, a ledge formed at one end of said wall, a cover member, a hinge connecting the other end of said wall to said cover member, such that said cover member may be pivoted with respect to said wall to expose said ledge, a lock barb on said ledge, and a tab on said cover member, said tab engaging said barb to attach said cover member to said ledge, said tab being adapted to be engaged and flexed to release said first member from said ledge.

7. A bracket according to claim 6 further comprising a panel spaced from said cover member and forming a channel between said panel and said cover member.

8. A bracket according to claim 7 wherein said panel is transparent so that anything positioned in said channel is visible.

9. A bracket according to claim 7 further comprising a second ledge connecting said panel to said cover member, said second ledge closing one side of said channel, the other sides of said channel being open.

10. A bracket according to claim 7 wherein said panel and said cover member are arcuate thereby providing a finished look to a shelf.

11. A bracket according to claim 6 further comprising a rib carried by said cover member, said barb being positionable between said rib and said tab.

12. A bracket according to claim 6 wherein said hook members include a first hook positioned near the top of said wall and a second hook near the bottom of said wall.

13. A bracket adapted to be attached to an edge of a shelf, the bracket comprising a wall, hook members carried by said wall and adapted to engage an edge of a shelf, a ledge formed at one end of said wall, a cover member, a hinge connecting the other end of said wall to one end of said cover member, a panel carried by the other end of said cover member, said panel being spaced from said cover member to form a channel therebetween, said panel being transparent so that anything positioned in said channel is visible through said panel, said ledge being visible only upon pivoting of said cover member with respect to said wall on said hinge, a lock barb on said ledge, and a tab on said cover member, said tab engaging said barb to attach said cover member to said ledge, said tab being adapted to be engaged and flexed to release said first member from said ledge.

14. A bracket according to claim 13 further comprising a second ledge connecting said panel to said cover member, said second ledge closing one side of said channel, the other sides of said channel being open.

15. A bracket according to claim 13 further comprising a rib carried by said cover member, said barb being positionable between said rib and said tab.

* * * * *